US008622443B2

(12) United States Patent
Tomaszewski

(10) Patent No.: US 8,622,443 B2
(45) Date of Patent: Jan. 7, 2014

(54) LOST MOTION CAM ACTUATING DEVICE

(75) Inventor: Kris Tomaszewski, Newmarket (CA)

(73) Assignee: Magna Closures Inc., Newmarket (CA)

( * ) Notice: Subject to any disclaimer, the term of this patent is extended or adjusted under 35 U.S.C. 154(b) by 1300 days.

(21) Appl. No.: 11/721,167

(22) PCT Filed: Dec. 9, 2005

(86) PCT No.: PCT/CA2005/001882

§ 371 (c)(1),
(2), (4) Date: Jun. 8, 2007

(87) PCT Pub. No.: WO2006/060921

PCT Pub. Date: Jun. 15, 2006

(65) Prior Publication Data

US 2009/0236862 A1 Sep. 24, 2009

Related U.S. Application Data

(60) Provisional application No. 60/634,580, filed on Dec. 9, 2004.

(51) Int. Cl.
*E05C 3/06* (2006.01)

(52) U.S. Cl.
USPC ..... 292/201; 292/216; 292/DIG. 23

(58) Field of Classification Search
USPC ..... 292/201, 216, 252, DIG. 23
See application file for complete search history.

(56) References Cited

U.S. PATENT DOCUMENTS

| | | | |
|---|---|---|---|
| 4,793,640 | A | 12/1988 | Stewart, Sr. |
| 5,474,338 | A | 12/1995 | Buscher |
| 5,503,441 | A | 4/1996 | Schwaiger |
| 5,577,583 | A | 11/1996 | O'Donnell |
| 5,603,537 | A | 2/1997 | Amano et al. |
| 5,634,677 | A | 6/1997 | Buscher et al. |
| 5,649,726 | A | 7/1997 | Rogers, Jr. et al. |
| 5,853,206 | A | 12/1998 | Kleefeldt et al. |
| 5,951,070 | A | 9/1999 | Spurr |
| 5,997,055 | A | 12/1999 | Strathmann |

(Continued)

FOREIGN PATENT DOCUMENTS

| | | | |
|---|---|---|---|
| DE | 4447687 | C2 | 5/1996 |
| DE | 19713864 | A1 | 10/1998 |

(Continued)

OTHER PUBLICATIONS

EP 05819610.6, Supplementary European Search Report, Jan. 21, 2013.

*Primary Examiner* — Kristina Fulton

(74) *Attorney, Agent, or Firm* — Millman IP Inc.

(57) ABSTRACT

A lost motion cam assembly for a vehicle lock. The assembly includes a lever, pivotally mounted to the housing and movable between locked and unlocked positions. A motor drives a gear mounted to a shaft in the housing. A cam is also rotatably mounted to the shaft, and includes a pair of opposing cam arms. When a cam arm engages a first interaction surface on the lever, the lever actuates. A second interaction surface on the lever stops the cam. The cam is operably connected to the gear by a lost motion connection that defines a range of free travel of the cam relative to the gear. Manually pivoting the lever while one of the pair of cam arms is in contact with the first interaction surface on the lever causes the cam to rotate within the range of free travel.

8 Claims, 5 Drawing Sheets

(56) References Cited

U.S. PATENT DOCUMENTS

| | | | | |
|---|---|---|---|---|
| 6,328,353 | B1 * | 12/2001 | Barczynski et al. | 292/216 |
| 6,338,508 | B1 | 1/2002 | Kleefeldt | |
| 6,428,058 | B1 | 8/2002 | Graute | |
| 6,511,107 | B2 * | 1/2003 | Barczynski et al. | 292/216 |
| 6,540,270 | B1 | 4/2003 | Reddmann | |
| 6,554,328 | B2 | 4/2003 | Cetnar et al. | |
| 6,575,507 | B2 | 6/2003 | Reddmann | |
| 6,598,911 | B2 | 7/2003 | Mejean et al. | |
| 6,733,052 | B2 | 5/2004 | Perkins et al. | |
| 7,261,333 | B2 * | 8/2007 | Tomaszewski | 292/201 |
| 2005/0200137 | A1 * | 9/2005 | Nelsen et al. | 292/201 |

FOREIGN PATENT DOCUMENTS

| | | | |
|---|---|---|---|
| DE | 10000708 | A1 | 7/2001 |
| EP | 1061212 | A2 | 12/2000 |
| EP | 1234936 | A1 | 8/2002 |

* cited by examiner

LOST MOTION CAM ACTUATING DEVICE

CROSS-REFERENCE TO RELATED APPLICATIONS

This application is a national phase entry filed under 35 U.S.C. section 371, of PCT application no. PCT/CA2005/001882 filed Dec. 9, 2005, which claims priority to U.S. Provisional No. 60/634,580 filed Dec. 9, 2004.

FIELD OF THE INVENTION

The invention relates to a cam assembly for actuating a lever, such as a lock lever or a power release detent on a vehicle latch.

BACKGROUND OF THE INVENTION

Power locking/unlocking is a popular feature for vehicle door latches. Typically, power-locking latches are equipped with a DC motor that drives a series of gears and cams to actuate a lock lever between the locked and unlocked position. However, for both safety and convenience purposes, the latch must also be able to be locked and unlocked manually. Preferably, manual locking/unlocking should not back drive the power-locking drive train. Previously, it has been difficult and/or expensive to produce an actuating device that allowed both manual and power locking and unlocking. In addition to power locking/unlocking, other components of the latch are becoming motorized. For example, some latches are now equipped with a power release feature. In a latch equipped with power release, the pawl is typically spring-biased against the ratchet. A DC motor drives the gear train to actuate the pawl into the released position. Once released, the motor must disengage to allow mechanical latching.

One solution is to provide a cam that can actuate the lock lever when the motor is engaged, but remains clear of the lock lever's motion path when the motor is disengaged. In this fashion, the lock lever can be manually actuated without difficulty. However, in practice it has been found that such systems do not always move fully clear of the lock lever's travel path. For example, when a cam is forced to stop rotating, it may bounce back into the path of the lock lever. In this case, the cam may partially or fully hinder manual actuation of the lock lever.

What is desired is an actuating device for a vehicle door latch that provides power locking/unlocking and reliably allows for manual locking/unlocking without manually back driving the drive train. What is also desired is an actuating device for a vehicle door latch that provides power release and allows manual latching. Additionally, the actuating device should be inexpensive to assemble.

SUMMARY OF THE INVENTION

According to a first aspect of the invention, there is provided an actuating device, particularly for a vehicle lock. The actuating device includes a lever, pivotally movable between two positions. The lever has a first interaction surface such as a fork, and a second interaction surface, such as a stop. The actuating device also includes a gear, selectively rotatable about an axis, and a cam, rotatable about an axis. The cam has a pair of cam arms for actuating or otherwise kinematically coupling with the lever such that one of the cam arms engages the first interaction surface to pivot the lever, and the other of the two cam arms engages the second interaction surface to stop the rotation of the cam. A lost motion connection is provided between the gear and the cam. The lost motion connection reduces the counter-rotation or "bounce-back" of the cam caused by engagement of the other of the two cam arms with the second interaction surface.

DETAILED DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
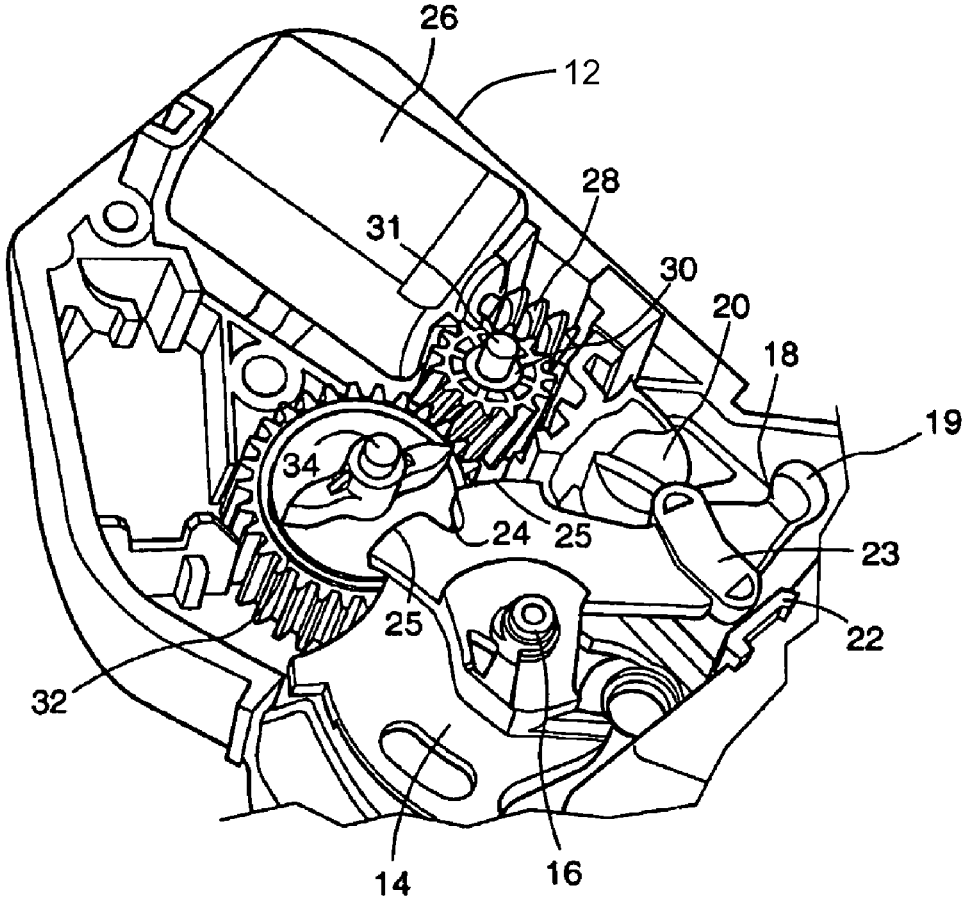
FIG. 1 shows a perspective view of a portion of a latch in accordance with a first aspect of the invention.

Referring now to FIG. 1, a latch is shown generally at 10. Latch 10 includes a molded housing 12, preferably formed from a high-impact plastic. A lock lever 14 is pivotally mounted to a post 16 integrally formed from and extending out of the inner surface of housing 12. Pivoting lock lever 14 actuates a lock link lever (not shown) that moves latch 10 into either a locked or an unlocked state. An arm 18 extends from lock lever 14 and terminates in a claw 19. The end of a door rod (not shown) connected to the inside lock lever (also not shown) is looped around claw 19. Thus, locking/unlocking the inside lock lever manually actuates lock lever 14. The angular travel of lock lever 14 is delimited by shoulders 20 and 22 integrally formed in housing 12. Lock lever 14 is movable between a "locked" position, where arm 18 abuts shoulder 20, and an "unlocked" position where arm 18 abuts shoulder 22. To reduce noise and wear, a lock lever bumper 23 is preferably mounted around arm 18. When lock lever 14 moves into either the locked or the unlocked position, bumper 23 abuts one of shoulder 20 and 22. Lock lever 14 further includes an indented region 24 located between two cam shoulders 25. Indented region 24 and cam shoulders 25 are used to power-actuate lock lever 14 and are described in greater detail below.

Lock lever 14 is power-actuated by the power-locking drive train. In the current embodiment, this power-locking drive train includes a lock motor 26 mounted to housing 12. Lock motor 26 is a DC motor, and reversibly drives a worm 28. Worm 28, in turn meshes with a cluster gear 30, rotatably mounted around pin 31. In turn, cluster gear 30 meshes a lock gear 32. As will be apparent to those of skill in the art, different gear arrangements between lock motor 26 and lock gear 32 can be used for the power-locking drive train, and are within the scope of the invention.

Figure 2:
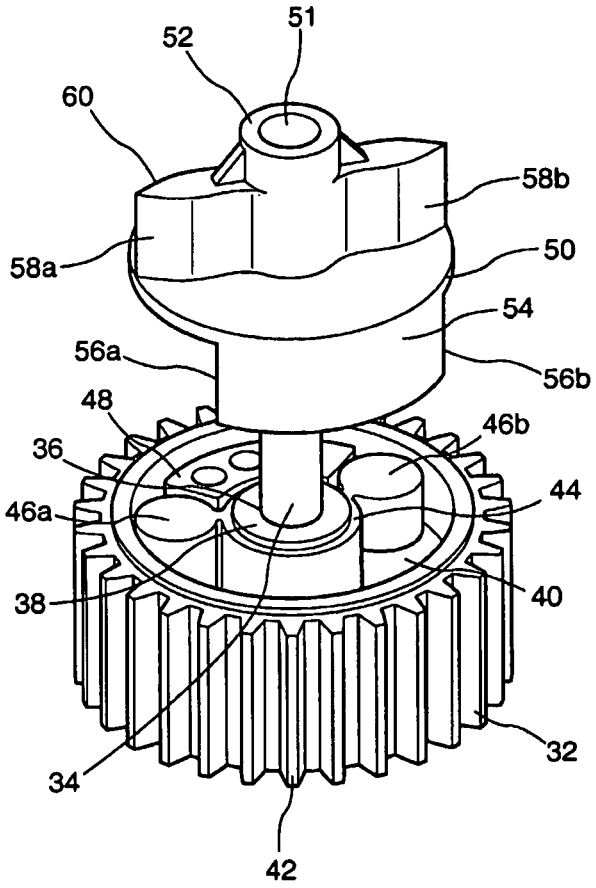
FIG. 2 shows an exploded view of the cam assembly shown in FIG. 1.

Lock gear 32 is rotatable about an axis defined by a shaft 34, located in a hole (not shown) in housing 12. Preferably, shaft 34 is fixed in the hole via friction or the like so that it does not rotate under normal use. As can be seen in FIG. 2, shaft 34 passes through a central hole 36 in an annular post 38 extending out from a planar surface of lock gear 32. Lock gear 32 includes a cavity 40 formed between annular post 38 and a teeth wall 42. A rubber ring 44 is mounted around annular post 38, and includes two resilient bumpers 46*a* and 46*b*. The two bumpers 46 abut against a lug 48 that extends out of lock gear 32 into cavity 40.

A cam 50 is also rotatably mounted to shaft 34, adjacent lock gear 32. Shaft 34 passes through a central hole 51 in an annular post 52 that is integrally formed from cam 50. Preferably, hole 51 provides a tighter frictional fit for shaft 34 than hole 36 on lock gear 32, so that cam 50 rotates less easily than lock gear 32. Cam 50 also includes a curved depending sidewall 54 that is adapted to fit within cavity 40 and is concentric with teeth wall 42. Depending sidewall 54 provides a lost motion connection between lock gear 32 and cam 50. The arc length of depending sidewall 54 between its edges 56*a* and 56*b* is shorter than the arc formed in cavity 40 between the two bumpers 46*a* and 46*b* so that cam 50 can rotate around shaft 34 independent of lock gear 36 between the two bumpers 46. Thus, the difference in arc length between bumpers 46*a* and 46*b* and edges 56*a* and *b* define a range of free travel of cam 50 relative to lock gear 32. Cam 50 further includes two opposing cam arms 58*a* and 58*b* that extend out from annular post 52 towards the circumference of cam 50. At the distal end of each cam arm 54 is a pair of opposing involute edges 60. As will be described in greater detail below, the profile of involute edges 60 are complementary to the edge of lock lever 14 within indented region 24.

Figure 3:
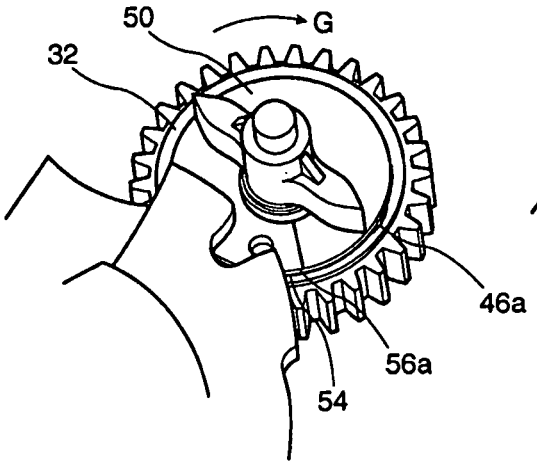
FIGS. 3 to 8 show an isolated view of the cam assembly and the lock lever shown in FIG. 1, moving from the unlocked to the locked position via power activation.

Power locking of latch 10 will now be described with additional references made to FIGS. 3 to 8. Rotation of lock lever 14, lock gear 32 and cam 50 are indicated by arrows labeled 'L', 'G', and 'C', respectively. To power-lock latch 10, engaging lock motor 26 drives worm 16, which in turn drives cluster gear 18. The lock gear 32 is driven by lock motor 26 in clockwise direction (FIG. 3). Cam 50 does not move yet due to the lost motion connection (i.e., bumper 46*a* is not yet in contact with edge 56*a* on depending sidewall 54 yet).

Figure 4:
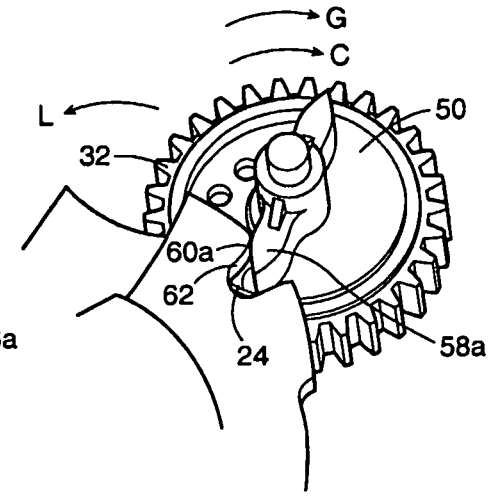
Figure 5:
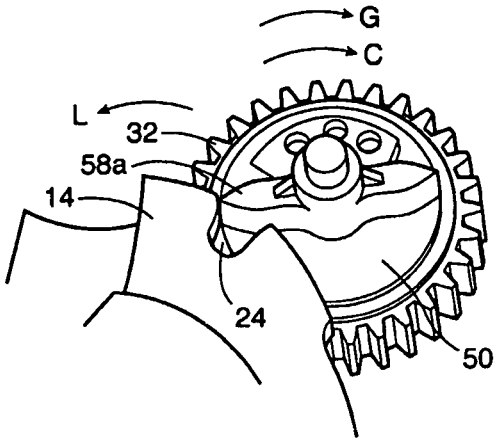

Once the lost motion is finished and the edge 56*a* on depending sidewall 54 abuts against the bumper 46*a*, lug 48 begins to transmit rotation force to depending sidewall 54 (FIG. 2), so that lock gear 32 and cam 50 rotate together in clockwise direction (FIG. 4). Cam arm 58*a* rotates into indented region 24 and the leading involute edge 60*a* begins to interact with a first engagement surface 62 formed on the edge of indented region 24 on lock lever 14, pivoting lock lever 14 in counterclockwise direction. First engagement surface 62 has an involute profile complementary to involute edges 60, reducing friction between lock lever 14 and cam arms 58.

Figure 6:
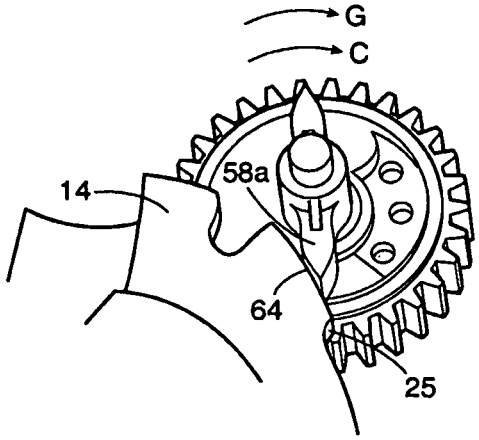
Figure 7:
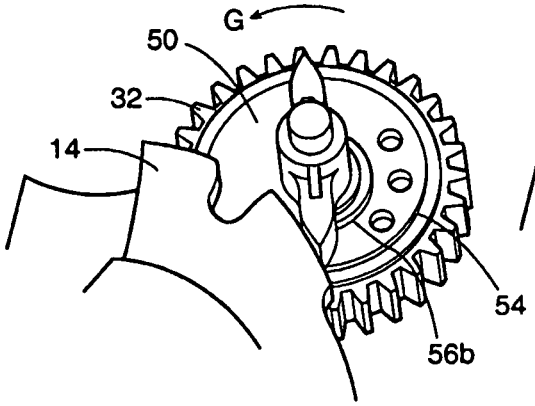

Lock gear 32 and cam 50 continue moving lock lever 14 until it reaches its full travel (FIG. 5) and moves into the locked position. Cam arm 58*a* disengages from lock lever 14, and lock gear 32 and cam 50 continue to rotate until the cam arm 58*b* hits a second engagement surface 64 located on shoulder 25 on the lock lever 14 (FIG. 6). As resistance from the second engagement surface 64 is encountered, bumper 46*b* (FIG. 2) is compressed and lock motor 26 stalls.

Once lock motor 26 is no longer driving lock gear 32, the energy accumulated in the compressed bumper 46*b* causes lock gear 32 to rebound and rotate in a counterclockwise direction, i.e., in the direction opposite to its previous travel (FIG. 7), back driving cluster gear 30 and worm 28. Friction between cam 50 and shaft 34 substantially prevents cam 50 from rotating with lock gear 32 until the end of lost motion is reached and bumper 46*b* (FIG. 2) abuts against edge 56*b* on depending sidewall 54.

Figure 8:
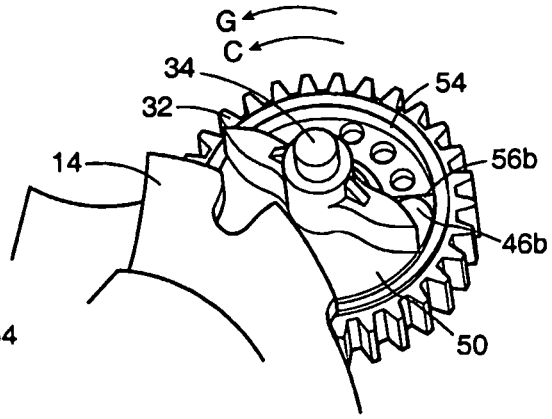

Once edge 56*b* on depending sidewall 54 abuts against bumper 46*b*, cam 50 begins to move with lock gear 32 counterclockwise (FIG. 8). The friction between cam 50 and shaft 34 slows down both cam 50 and locking gear 32. FIG. 8 shows the approximate position where cam 50 and locking gear 32 stop after rebound. With cam 50 and locking gear 32 in this position, locking lever 14 can be manually moved between the locked and unlocked positions without moving cam 50, locking gear 32 or motor 26. Additionally, all three are ready for next locking or unlocking power cycle.

Figure 9:
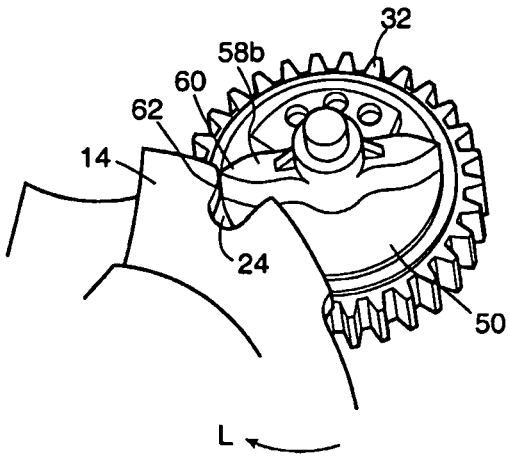
FIGS. 9 to 10 show an isolated view of the cam assembly and the lock lever shown in FIG. 1, moving from the locked to the unlocked position via manual activation.
Figure 10:
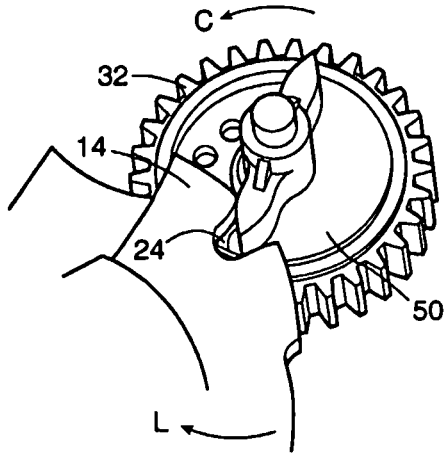

If cam 50 and locking gear 32 keep moving in the rebound direction past the position shown in FIG. 8, cam 50 will eventually end up in indented region 24 of locking lever 14 (FIG. 9). In this condition, locking lever 14 can still be operated manually because of the lost motion connection between cam 50 and locking gear 32. Locking lever 14 is rotated manually in clockwise direction until the first engagement surface 62 along indented region 24 engages involute edge 60 on cam arm 58*b*. Because of the lost motion between locking gear 32 and cam 50, cam 50 rotates within its range of free travel, but locking gear 32 remains in place (FIG. 10). Thus there is no back drive of motor 26. Locking lever 14 has reached its full travel into the unlocked position. It can now be rotated manually back and forth without increased efforts caused by moving locking gear 32 and motor 26. Power cycle can also be started in any direction.

Figure 11:
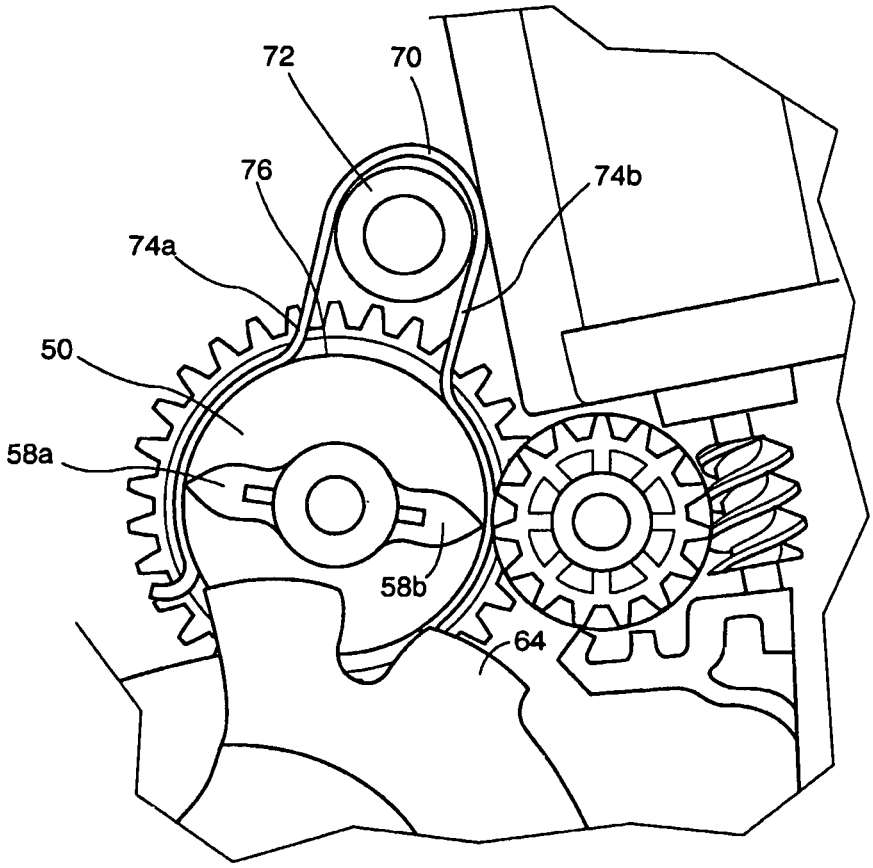
FIG. 11 shows an isolated view of the cam assembly in accordance with a second embodiment of the invention.

Referring now to FIG. 11, a second embodiment of the invention is shown in greater detail. A friction spring 70 is located around a post 72 formed in the surface of housing 12. Arms 74*a* and 74*b* are biased against a perimeter sidewall 76 in cam 50. When cam 50 rotates, friction spring 70 remains stationary due to being looped around post 72. Friction created between perimeter sidewall 76 and spring arms 74*a* and 74*b* reduces bounce-back of cam 50 at the end of travel after one of the cam arms 58*a* or 58*b* hits second engagement shoulder 64. The drag caused by friction spring 70 is not sufficient to significantly hinder movement of cam 50 during power lock/unlock via lock motor 26 or by manual lock/unlock via pivoting lo lock lever 14.

While the present embodiment of the invention relates to using a lost-motion actuating device to actuate a locking lever, it will be understood that the actuating device can be used to actuate other latch components. For example, the actuating device could be used to actuate a pawl for a power release feature. The pawl is spring-biased against a ratchet (which engages a striker bar to latch the door). Activating the power-release motor causes the cam to pivot the pawl and release the ratchet. When the latch is manually actuated, the pawl can pivot freely between without back-driving the motor. Other uses of the lost-motion actuating device will occur to those of skill in the art. The above-described embodiments of the invention are intended to be examples of the present invention and alterations and modifications may be effected thereto, by those of skill in the art, without departing from the scope of the invention which is defined solely by the claims appended hereto.

I claim:

1. An actuating device, particularly for a vehicle lock, comprising:

a lever, pivotally movable between two positions, the lever having a first interaction surface and a second interaction surface;

a gear, selectively rotatable about a gear axis; and a cam connected to the gear via a lost motion connection, rotatable about a cam axis, having a pair of cam arms for actuating the lever, wherein rotation of the cam from a first position to a second position drives one of the cam arms to pivot the lever by engagement of the said one of the cam arms with the first interaction surface, and wherein when the cam is in the second position the other of the two cam arms engages the second interaction surface which prevents the rotation of the cam beyond the second position, wherein the cam is drivable from the first position to the second position by the gear through the lost motion connection, wherein the cam rotates about the cam axis against greater frictional resistance than the gear rotating about the gear axis, such that, upon a release of a force on the gear to drive the other of the two cam arms into engagement with the second interaction surface, a resulting bounceback of the cam and gear drives the gear to rotate through a greater angle than the cam rotates through, resulting in some lost motion between the gear and the cam.

2. The actuating device of claim 1, wherein the lost motion connection defines a range of free travel of the cam relative to the gear so that manually pivoting the lever while one of the pair of cam arms is in contact with the first interaction surface on the lever causes the cam to rotate within the range of free travel.

3. The actuating device of claim 1, wherein the cam is coaxial with the gear.

4. The actuating device of claim 3, wherein the lost motion connection includes:

a lug extending out from a planar surface of the gear;

a sidewall, depending from an opposing planar surface on the cam so that rotating the cam causes one edge of a pair of edges on the sidewall to engage the lug; and wherein the range of free travel is the distance the cam must rotate from when one edge of the pair of edges engages the lug to when the other edge of the pair of edges engages the lug.

5. The actuating device of claim 4, wherein the lost motion connection further includes a bumper located between the lug and each of the sidewall edges.

6. The actuating device of claim 5, wherein each of the pair of cam arms is opposing the other of the pair of cam arms.

7. The actuating device of claim 1, wherein counter rotation of the cam is further reduced due to frictional resistance being applied to an exterior perimeter of the cam.

8. The actuating device of claim 1, wherein a friction spring located around a post in the actuating device applies the frictional resistance to the exterior perimeter of the cam.

* * * * *